United States Patent [19]

Dobi

[11] 4,401,040

[45] Aug. 30, 1983

[54] THERMAL TORCH

[75] Inventor: Tibor J. Dobi, Budapest, Hungary

[73] Assignee: Volcano Corporation, Holland, Ohio

[21] Appl. No.: 313,468

[22] Filed: Oct. 21, 1981

[51] Int. Cl.[3] ..... F23B 7/00

[52] U.S. Cl. ..... 110/349; 266/48; 431/99

[58] Field of Search ..... 110/349; 431/99; 266/48

[56] References Cited

U.S. PATENT DOCUMENTS

| | | |
|---|---|---|
| 3,260,076 | 7/1966 | Humberg . |
| 3,460,223 | 8/1969 | Berczes et al. . |
| 3,487,791 | 1/1970 | Dalm . |
| 3,507,230 | 4/1921 | Seib . |
| 3,507,231 | 4/1970 | Meier . |
| 3,570,419 | 3/1971 | Brandenberger . |
| 3,602,620 | 8/1971 | Fassler . |
| 3,738,288 | 6/1973 | Brandenberger . |
| 3,921,542 | 11/1975 | Brandenberger . |
| 4,050,680 | 9/1977 | Sweeney . |
| 4,055,332 | 10/1977 | Sweeney . |
| 4,069,407 | 1/1978 | Brower . |
| 4,114,863 | 9/1978 | Campana . |

*Primary Examiner*—Edward G. Favors

*Attorney, Agent, or Firm*—Wilson, Fraser, Barker & Clemens

[57] ABSTRACT

A new and improved thermal torch or lance useful in boring, cutting, burning, and the like, of hard base materials having a metal burner pipe with fusible wire or rod-like elements therein forming gas passages therebetween. The wire or rod-like elements are surface-pitted by oxidation or other means to cause turbulence within the transient gaseous oxygen stream caused to pass through the torch assembly is heated at the outlet end of the torch to cause an effectively concentrated thermic reaction with the metallic burner pipe and the associated rod-like elements. The result is an exceptionally efficient cutting temperature.

7 Claims, 4 Drawing Figures

THERMAL TORCH

BACKGROUND OF THE INVENTION

The present invention relates to thermal cutting torches and more particularly to a cutting torch of the consumable thermal torch type.

The thermal torch of the invention is typically employed for boring, cutting, and burning of hard-base material such as concrete, for example.

Such devices are typically fueled with oxygen gas which, for many years, has been used for piercing and cutting holes in hard base material such a concrete, slag, rock, and practically all ferrous metals. Such torches are comprised of an elongate all ferrous metal hollow pipe communicating at one end thereof with a source of oxygen which is caused to pass through the torch assembly. In operation, the thermic reaction of the cutting torch is initiated, with oxygen flowing therefrom, by exposing the outlet nozzle end of the torch to a preheated area whereupon ignition occurs. The thermic reaction then oxidizes the material to be treated with sufficient heat being produced to continue the cutting or piercing operation with the oxygen alone without any additional heat or flame required to facilitate the operation. The outlet nozzle end of the torch is maintained within a hole in the material being cut such that an oxygen stream emerges at the point of oxidation. The resultant heat is sufficient to actually burn the outermost distal end of the burner pipe so that as the operation proceeds, the torch assembly is consumed and must be replaced from time to time with a new length of burner pipe. Only a small portion of the oxygen consumed is required by the oxidation of the cutting torch itself, but it must be understood that the exothermic reaction of the burning torch greatly assists in supplying energy for the cutting operation.

It has been noted that the cutting action of such a cutting tooth structure could be increased by the employment of fusible rods disposed within the interior of the burner pipe. The resultant pipe and rod inserts provide additional fuel and greater energy output from the assembly. The insertion of the rods within the hollow interior portion of the burner pipe also manifestly decrease the area through which the oxygen fuel may travel so that the oxygen streams travel at greater velocity through the torch assembly. Among the problems created by such a structure is the increased erroding effect on the material being treated which increases splattering effect from and at the discharge of the torch and also the spreading of the cutting flame, so that the cutting action is not concentrated to achieve maximum cutting efficiency.

Most of the recent developments of this particular type of thermal cutting torch have been directed to the disposition of the centrally disposed rods and the various components for maintaining the rods in a desired configuration within the interior of the burner pipes, such as exemplified by U.S. Pat. Nos. 3,260,076; 3,460,223; 3,487,791; 3,507,230; 3,507,231; 3,507,419; 3,602,620; 3,738,288; 3,921,542; 4,050,680; 4,055,332; and 4,114,863.

SUMMARY OF THE INVENTION

The present invention is directed to an improvement in structure and resultant operation of the devices such as disclosed in the above-referenced patents resulting in an increased cutting efficiency.

The above objectives are typically achieved by a consumable thermal cutting torch assembly including an elongate burner pipe having a longitudinal axis; a first and second set of elongate consumable rods disposed within the interior of the burner pipe and having longitudinal axes parallel to and coextensive with the burner pipe and having substantially identical cross-sectional configurations; the outer surfaces of the rods of the first set are positioned to contact adjacent rods of the first set and the adjacent inner wall of the burner pipe, the outer surfaces of the rods of the second set are positioned to contact adjacent rods of the second set and the outer surfaces of adjacent rods of the first set, the first set of rods and the inner surface of the burner pipe cooperating to establish a first pressure oxygen passage, the second set of rods and the first set of rods cooperating to establish a second pressure oxygen passage extending internally of and coextensive with the first and having a capacity greater than the capacity of the first pressure oxygen passage; and means providing communication between one end of the burner pipe and a source of oxygen under pressure.

Since the cutting efficiency of the thermal torch of the invention is a function of the heat energy output of the resultant thermic reaction of the torch assembly, the temperature achieved at the nozzle or outlet end is an extremely important feature. It has been found that imparting irregularities to the outer surfaces of the fusible rod elements and to the inner surface of the associated burner pipe enabled the assembly to achieve considerably higher cutting temperatures. The surface irregularities can be realized by allowing the stock used for forming the burner pipe and the fusible rod elements to oxidize by exposing the same to the ambient environment. Manifestly, methods can be employed to accelerate the normal oxidation process, such as the use of salt baths or the like.

Further, it has been found that advantageous results are achieved by physically stretching the rod elements prior to insertion into the burner pipe.

The unique configuration of the burner pipe and the associated fusible rod elements has resulted in a device capable of producing a thermic reaction to form a concavely-shaped nozzle end which will effectively focus the products of the thermic reaction and thereby minimize energy dissipation.

BRIEF DESCRIPTION OF THE DRAWINGS

The above, as well as other, objectives and advantages of the invention will become clearly manifest to one skilled in the art from reading the following detailed description of an embodiment of the invention when considered in the light of the accompanying drawings in which.

DETAILED DESCRIPTION OF THE PREFERRED EMBODIMENT OF THE INVENTION

Figure 1:
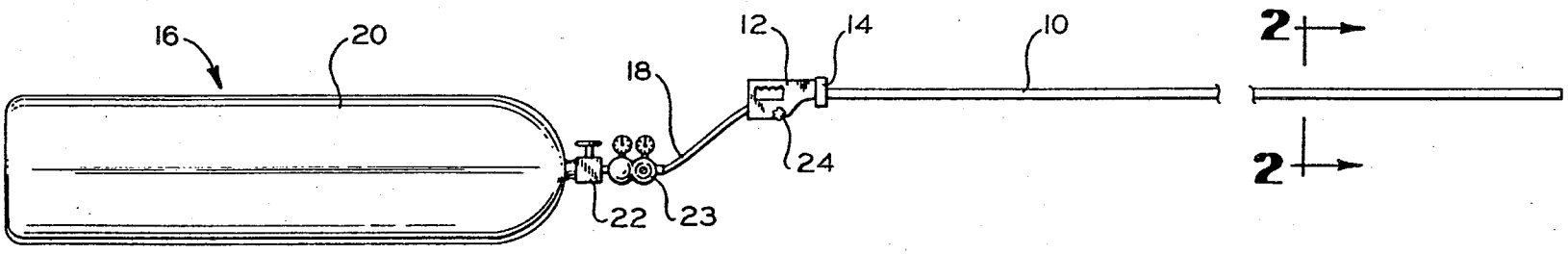
FIG. 1 is a somewhat schematic side elevational view of a thermal torch incorporating the features of the invention.

Referring to FIG. 1, there is shown apparatus including a thermal torch incorporating the features of the invention. The apparatus includes a burner pipe 10 of any desired length, one end of which is detachably coupled to a valve housing 12. The valve housing 12 is provided with a sealing collet 14 capable of coupling one end of the burner pipe 10.

The valve housing 12 is also coupled to a source 16 of gaseous fuel, such as oxygen, through a suitable conduit 18. The source 16 of gaseous oxygen may typically include a tank-like cylinder 20 having a manually actuated valve 22 and a pressure reducing valve 23.

The valve housing 12 is further provided with an internal valve means having an externally disposed manually operated knob 24.

The burner pipe 10 may be comprised of an iron or steel pipe which is open at both ends. While the burner pipe 10 may be of any desired length, it is preferable that it be of such a length that it is physically manipulatable. It has been found that a length of the order of three hundred (300) cm. is acceptable. Also, it has been found that satisfactory results have been achieved by utilizing a black annealed steel pipe having an inner diameter of 12.65 mm. and a wall thickness of 2.3 mm.

Figure 2:
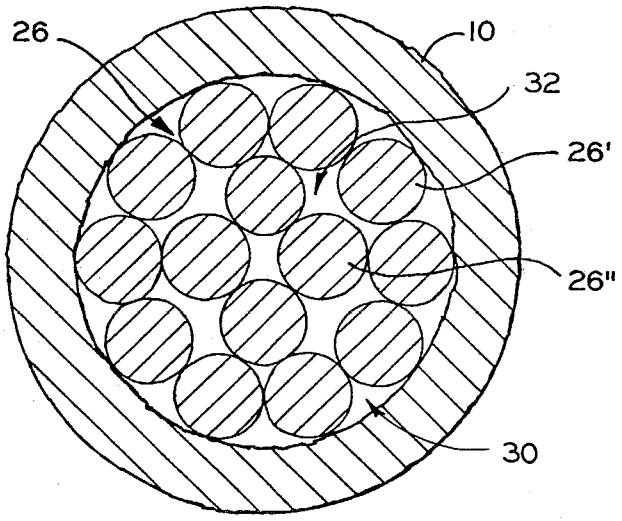
FIG. 2 is an enlarged sectional view of the burner pipe of the invention taken along the line 2—2 of FIG. 1.
Figure 3:
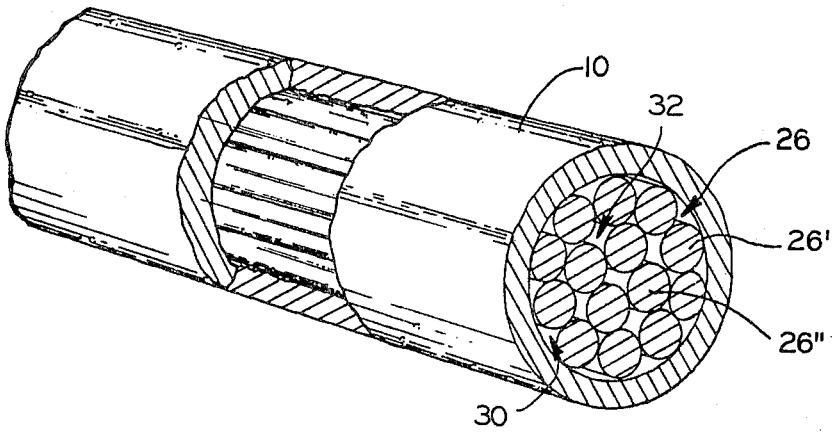
FIG. 3 is an enlarged fragmentary view of the burner pipe of the invention with portions broken away to show the internally disposed fusible elements.

Fusible rods 26 are disposed within the interior of the burner pipe 10. The rods 26 are coextensive with the burner pipe 10; their axes are parallel with one another and to the longitudinal axis of the burner pipe 10. In the preferred embodiment of the invention, the rods 26 are formed of 12½ gauge black annealed steel wire stock and are tightly packed within the interior of the burner pipe 10. In such embodiment, there are fourteen rods 26 which are actually disposed in such a manner that there is an outer array of rods 26' and an inner array of rods 26''. The surface of the rods 26' of the outer array are in contact with those of the adjacent rods on each side and with the interior wall surface of the burner pipe 10. The surface of the rods 26'' of the inner array are in contact with those of the adjacent rods 26'' on each side and, with those of the adjacent ones of the rods 26' of the outer array. The disposition of the rods 26 is clearly illustrated in FIGS. 2 and 3.

It will be noted that the rods 26' of the outer array cooperate with the inner wall of the burner pipe 10 to form elongate passageways, generally indicated by reference numeral 30, which collectively form an outer passage for gaseous oxygen under pressure emanating from the source 16. In a similar manner, the rods 26'' of the inner array cooperate with one another and with the rods 26' of the outer array to form elongate passageways, generally indicated by reference numeral 32, which collectively form an inner passage coaxial with the outer passage for the gaseous oxygen under pressure emanating from the source 16. The outer passage is of a volume and, therefore capacity, less than the volume and capacity of the inner passage. Accordingly, since both the outer and inner passages are in communication with the gaseous oxygen, the inner passage is capable of providing more oxygen to the nozzle or outlet end of the burner pipe 10 during operation. The significance of the above relationship will become apparent in the following description of the operation of the thermal torch of the invention.

It has been found that excellent results are achieved in the thermal torch of the invention when the inner surface of the burner pipe 10 and the outer surfaces of the fusible rods 26 are pitted, for example because of rusting. It is believed that the surface irregularities formed by rusting cooperate with the transient gaseous oxygen to form eddy currents in the transient stream to effect increased turbulence during the thermic reaction which occur during operation of the thermal torch of the invention.

Also, it has been found desirable to stretch rod stock, and then to insert the stretched stock into the burner pipe 10 as the rods 26. It is believed that such stretching further enhances the thermic reaction, thereby increasing the cutting temperatures.

Figure 4:
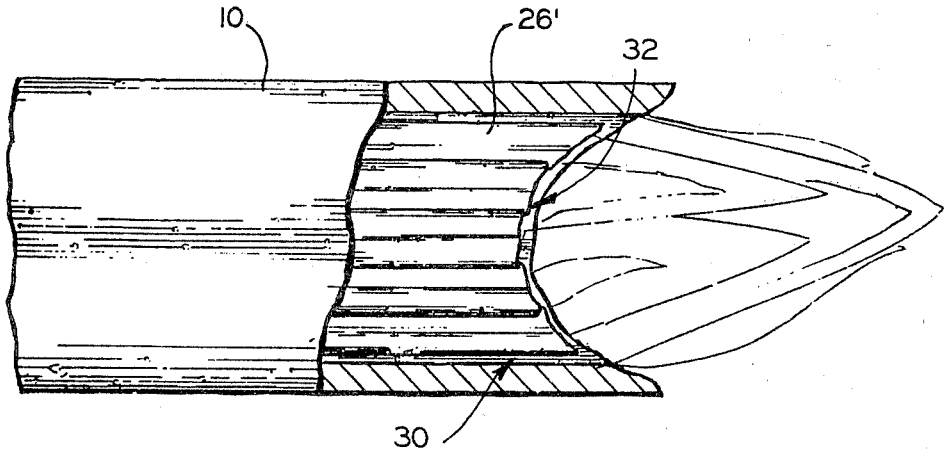
FIG. 4 is an enlarged fragmentary view of the nozzle or outlet end of the burner pipe illustrated in FIGS. 1, 2, and 3 with portions broken away to show the configuration of the burner pipe and the associated fusible elements during the operation of the torch according to the invention.

In operation, valve 22 is opened and the valve pressure reducing 23 is set to provide an initial pressure of 75 p.s.i.; the valve actuated by the knob 24 is then opened to allow the pressurized oxygen within the tank 20 to pass through the burner pipe in the aforementioned outer and inner passages. At this point the thermic reaction is suitably initiated at the nozzle or outlet end of the burner pipe 10. The temperature is then allowed to increase through a point at which the fusible rods 26 and the burner pipe 10 are consumed by rapid oxidation. Since the oxygen flowing in the inner passage is of a greater volume than the oxygen flowing in the outer passage, the temperature gradients at the nozzle end causes the exit end of the burner pipe 10 and the outermost ends of the rods 26 to burn into a concave shape as shown in FIG. 4. The pressure reducing valve 23 is then set to increase the pressure of the transient gaseous oxygen to approximately 150 p.s.i. At this point, a flame emanating axially from the outlet end of the burner pipe 10 can reach a temperature of twenty thousand nine hundred sixty degrees Farenheit.

The concavity of the outlet end of the burner pipe assembly causes the focusing and concentration of the heat energy to provide an extremely efficient cutting action.

It has been found that the initial ignition of the thermic reaction can be achieved at approximately 2300°–2400° Celsius. The average operating temperature is 3200° Celsius, and the high temperature has been found to be in the order of 3500° Celsius with the parameters set forth in the foregoing description.

Further, normally the pressure of the transient gaseous oxygen is in the order of 150 p.s.i. However, there are instances where the pressure of the gaseous oxygen may be raised to approximately 200 p.s.i.

From the above description, it will manifest that a relatively simple structure has been produced to provide a highly efficient thermal torch for cutting and burning hard base materials such as concrete.

In accordance with the provisions of the patent statutes, I have explained the principle and mode of operation of my invention and have illustrated and described what I now consider to represent its best embodiment. However, I desire to have it understood that, within the scope of the appended claims, the invention may be practiced otherwise than as specifically illustrated and described.

What is claimed is:

1. A thermal torch comprising:

an elongate burner pipe having a longitudinal axis and open at both ends;

a bundle of elongate consumable rods disposed within the interior of said burner pipe, said rods having longitudinal axes parallel to and coextensive with said burner pipe and said rods having substantially identical cross-sectional configurations, said rods arranged to form at least a first and a second pressure fuel passage, the first passage extending between the inner surface of said burner pipe and the outer surfaces of the ones of said rods which are disposed adjacent the inner surface of said burner pipe, and the second passage extending between the inner surfaces of the ones of said rods which are disposed adjacent the inner surface of said burner pipe and the outer surfaces of the remainder of said rods, the first and second passages being longitudinally coextensive with each other and with said burner pipe, the second passage having a greater capacity than the capacity of the first passageway; and means providing communication between one end of said burner pipe and a source of oxygen under pressure.

2. The invention defined in claim 1 wherein the there are irregularities on the outer surfaces of said rods.

3. The invention defined in claim 2 wherein there are irregularities on at least the inner surface of said burner pipe.

4. The invention defined in claim 3 wherein said burner pipe and said rods are formed of a ferrous metal.

5. The invention defined in claim 4 wherein the inner diameter of sid burner pipe is 12.65 mm.

6. The invention defined in claim 5 wherein the bundle includes fourteen of said rods.

7. The invention defined in claim 1 wherein said rods are physically stretched prior to insertion into said burner pipe.

* * * * *